US006467794B1

(12) United States Patent
De France

(10) Patent No.: US 6,467,794 B1
(45) Date of Patent: Oct. 22, 2002

(54) DEVICE FOR FIXING A SHELL FOR MAINTAINING A BOOT OF A SNOW SURF BOARD

(75) Inventor: Guillaume De France, Grenoble (FR)

(73) Assignee: Emery S.A. (FR)

( * ) Notice: Subject to any disclaimer, the term of this patent is extended or adjusted under 35 U.S.C. 154(b) by 0 days.

(21) Appl. No.: 09/744,902

(22) PCT Filed: Nov. 4, 1998

(86) PCT No.: PCT/IB98/01763

§ 371 (c)(1),
(2), (4) Date: Jan. 30, 2001

(87) PCT Pub. No.: WO99/25434

PCT Pub. Date: May 27, 1999

(30) Foreign Application Priority Data

Nov. 19, 1997 (CH) ..... 2674/97

(51) Int. Cl.[7] ..... A63C 9/00
(52) U.S. Cl. ..... 280/607; 280/618
(58) Field of Search ..... 280/11.14, 607, 280/613, 618, 620, 626, 633, 634

(56) References Cited

U.S. PATENT DOCUMENTS

| | | | | | |
|---|---|---|---|---|---|
| 5,667,237 | A | * | 9/1997 | Lauer | 280/607 |
| 5,732,959 | A | * | 3/1998 | Soejima | 280/607 |
| 5,868,416 | A | * | 2/1999 | Fardie | 280/607 |
| 5,890,729 | A | * | 4/1999 | Bayer et al. | 280/618 |
| 5,913,530 | A | * | 6/1999 | Berger et al. | 280/607 |
| 5,915,718 | A | | 6/1999 | Dodge | |
| 5,947,488 | A | * | 9/1999 | Gorza et al. | 280/607 |
| 5,984,346 | A | * | 11/1999 | Keller | 280/607 |
| 6,007,085 | A | * | 12/1999 | Rigal et al. | 280/607 |

FOREIGN PATENT DOCUMENTS

| | | |
|---|---|---|
| EP | 0818221 | 7/1997 |
| EP | 0815905 | 1/1998 |
| FR | 2702388 | 9/1994 |
| WO | 96/22136 | 7/1996 |
| WO | 97/33664 | 9/1997 |

* cited by examiner

*Primary Examiner*—Brian L. Johnson
*Assistant Examiner*—Christopher Bottorff
(74) *Attorney, Agent, or Firm*—Wall Marjama & Bilinski LLP

(57) ABSTRACT

A shell having on its external surface, also called sole, a circular opening comprising a rim with teeth for receiving said device for fixing the shell to the surf board. Said device consists of a first circular part (1) fixed on the surf board defining at its lower portion housings (15) with the surf board surface and retaining at its periphery a second circular part (2) fixed in rotation with said first part leaving it free to move in the direction perpendicular to the surf board over a predetermined distance. The second part has at its lower surface teeth (21) corresponding to said shell teeth. The device further comprises a third circular part (3) arranged beneath the first part in said housings, that is between the surf board and said first part, maintained fixed by the latter in the perpendicular direction but in free rotation over a predetermined angle. The third part has at its periphery projecting segmetns (31) in the form of a ram pin the direction perpendicular to the surf board, said projecting segments being urged by their ramps into contact with corresponding ramps (25) arranged on the second part internal periphery (23) such that a rotation by a predetermined angle of the third part (3) presses the second part against the shell thereby maintaining it in a predetermined position relative to the surf board.

2 Claims, 4 Drawing Sheets

DEVICE FOR FIXING A SHELL FOR MAINTAINING A BOOT OF A SNOW SURF BOARD

BACKGROUND OF THE INVENTION

The subject of the invention is a device fastening a shell intended for holding a boot on a snowboard.

SUMMARY OF THE INVENTION

Snowboard fastenings are known which comprise a shell intended for receiving and holding a boot. These fastenings have devices making it possible to orient them so that the user can arrange his feet in the best possible way. There is a plurality of devices making it possible to carry out these operations more or less easily. All these devices are relatively complicated and therefore costly.

The object of the invention is to provide a simple device which comprises a minimum of components, is therefore inexpensive and can be used with commercially available plastic shells.

The device fastening a shell intended for holding a boot on a snowboard, defined in claim 1, achieves the objects set out above.

The invention will be understood better and its advantages will emerge more clearly from a reading of the description of an embodiment given purely by way of example, with reference to the drawings in which:

DESCRIPTION OF THE INVENTION

Figure 1:
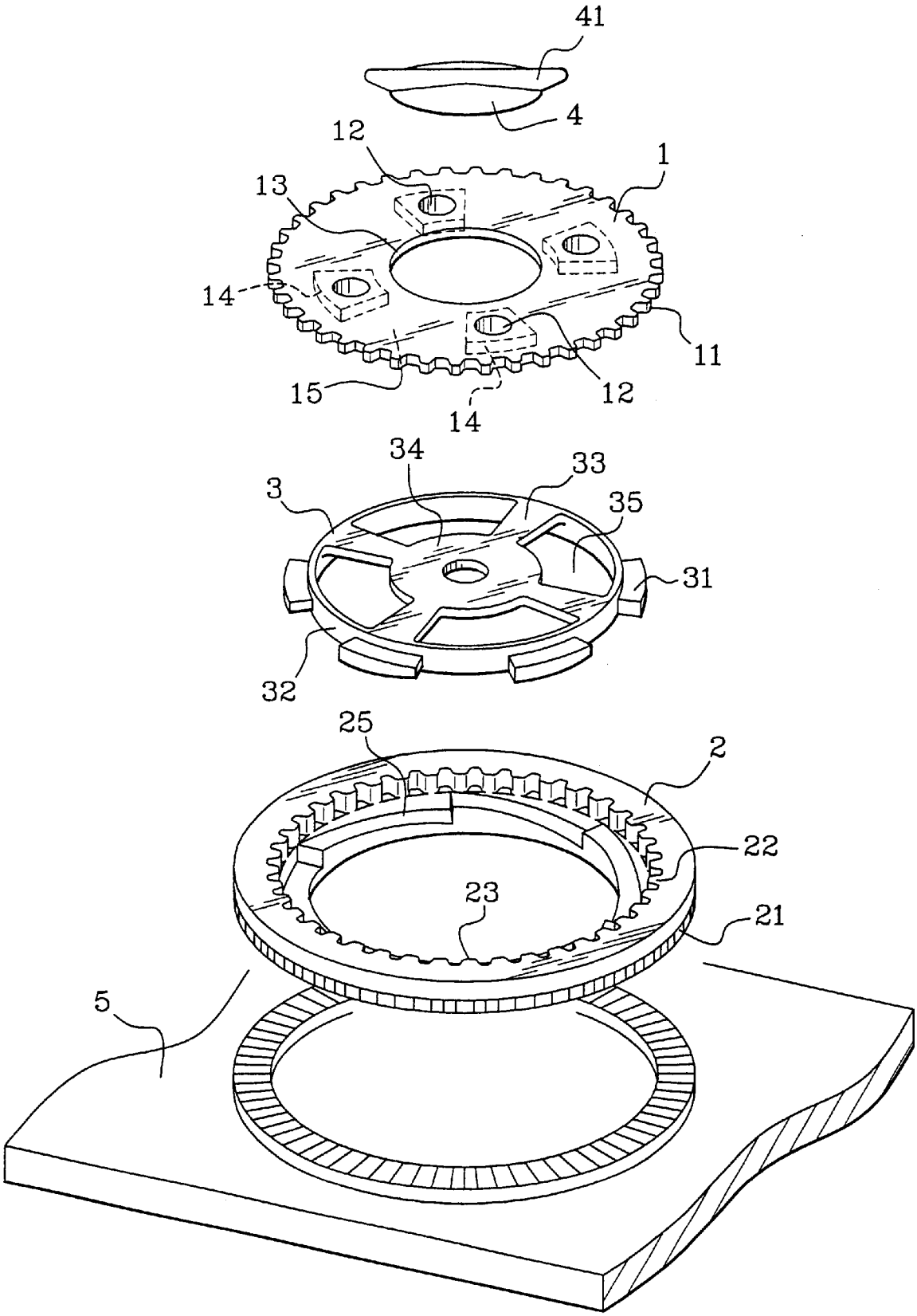
FIG. 1 shows an exploded perspective view of a device according to the invention.
Figure 4:
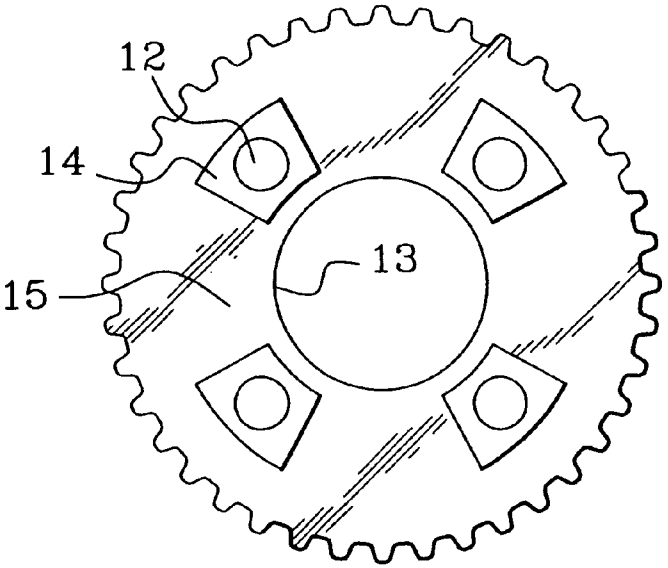
FIGS. 2, 3 and 4 show a first component of the device of FIG. 1 in a top view, in a bottom view and in section respectively.
Figure 3:
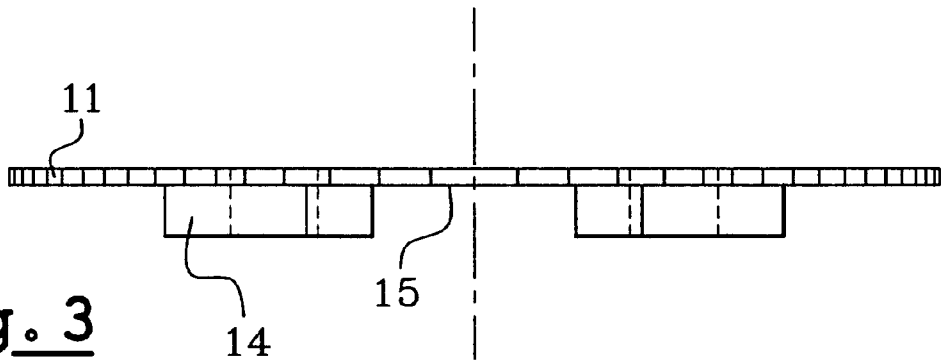
Figure 2:
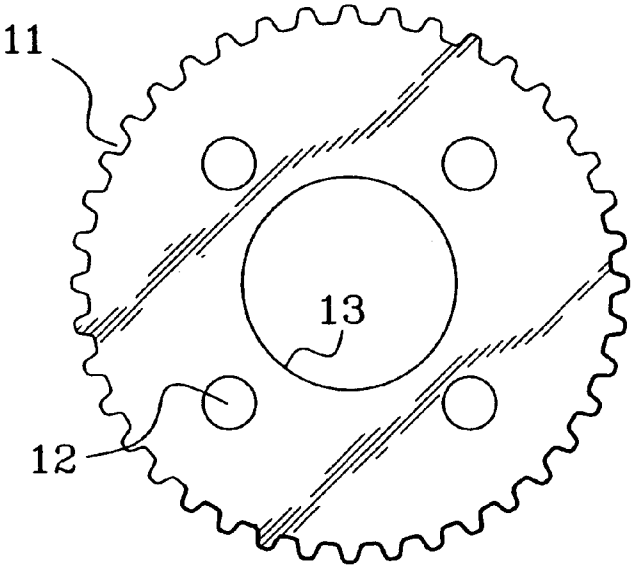
Figure 6:
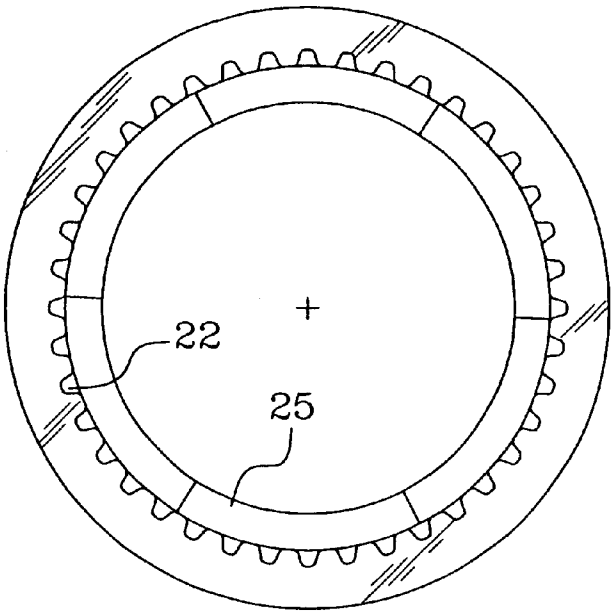
FIGS. 5, 6 and 7 show a second component of the device of FIG. 1 in a top view, in a bottom view and in section respectively.
Figure 5:
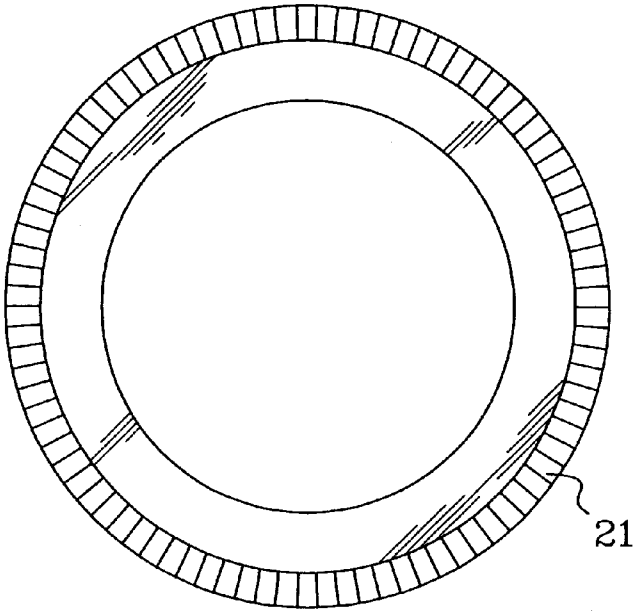
Figure 7:
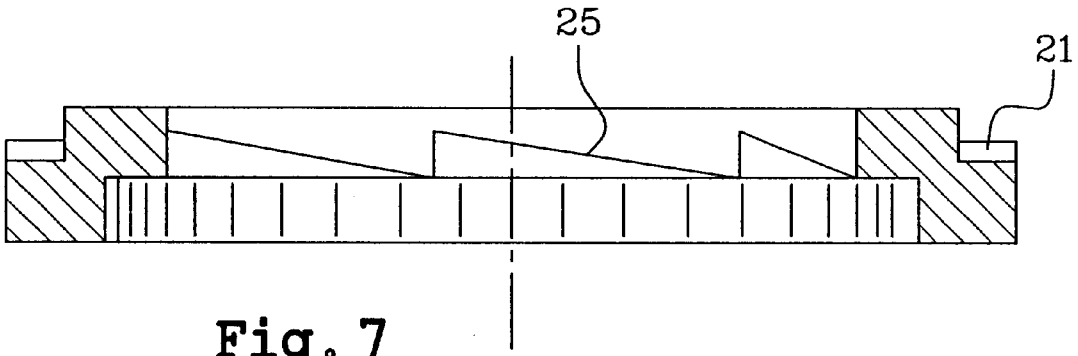
Figure 9:
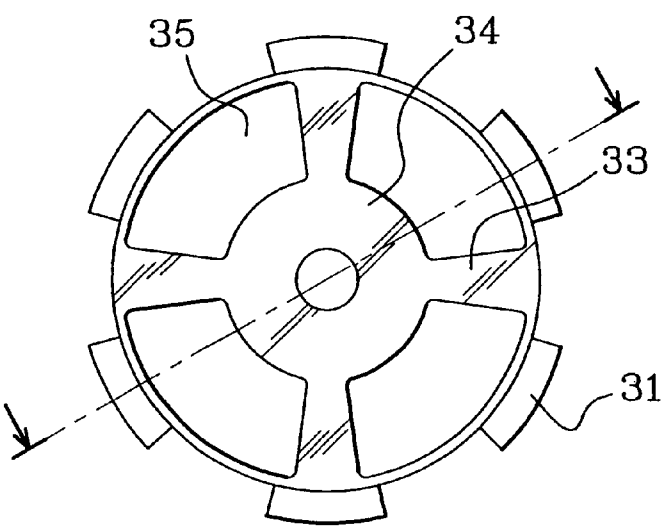
FIGS. 8, 9 and 10 show a third component of the device of FIG. 1 in a top view, in a bottom view and in section respectively.
Figure 8:
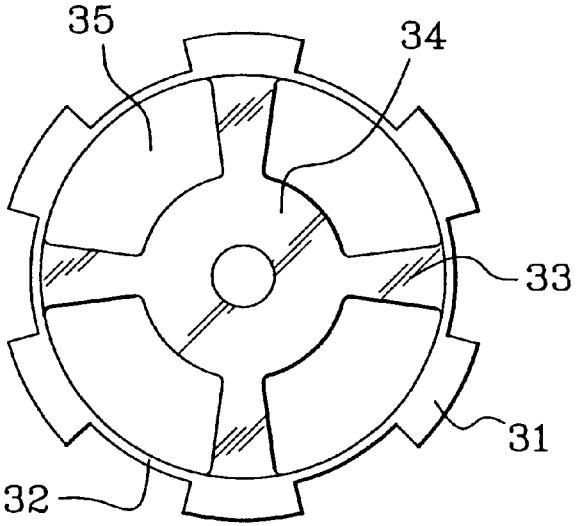
Figure 10:
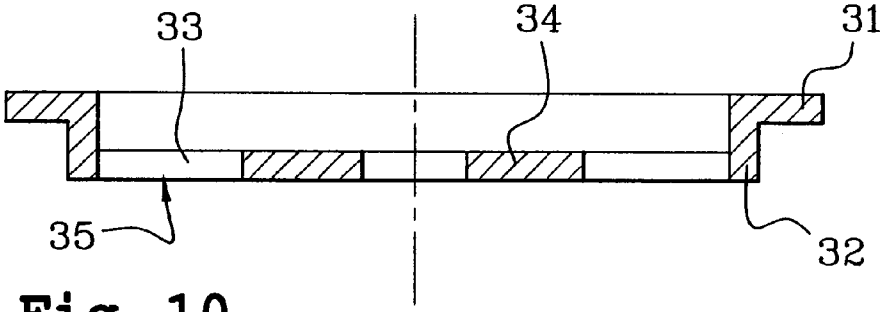

As can be seen in FIG. 1, a device according to the invention comprises four main components numbered from 1 to 4.

Component 1 consists of a ring-shaped element 1 having four thicknesses. A first thickness defines the upper surface which has, on its outer periphery, teeth 11 intended for snapping into indentations 22 provided for this purpose in component 2. Once component 1 is arranged in component 2, these two components are integral in terms of rotation, while a relative translational movement perpendicular to their plane remains possible. A second thickness represents a rim onto which component 3 will come to bear. A third thickness defines a surface on which are arranged cleats 14 representing the fourth thickness. Once component 1 is fastened to the snowboard, these cleats 14 define, with the surface of the latter, receptacles 15 in which the spokes 33 of component 3 will be arranged. Component 1 also has drillholes 12, four in the embodiment illustrated, which are intended for receiving screws making it possible to fasten said component to the snowboard, and an inner surface 13 having a diameter corresponding to the central part of component 3.

Component 2 consists of a ring-shaped element comprising two thicknesses, so as to have a rim on its periphery. This rim comprises a toothing 21 corresponding to the toothings found on shell 5. Component 2 comprises, on part of its inner surface, indentations 22 intended for receiving the teeth 11 of component 1 and, on the other part of its inner surface, component 2 has helical ramps 25 which may also be plane elements inclined relative to the plane of the ring. These ramps 25 are intended for cooperating with protuberances 31 arranged on the periphery of component 3.

Component 3 takes the form of a wheel having a central hub 34 and an outer ring 32. The central hub 34 is connected to the ring 32 by means of spokes 33, four in the embodiment illustrated. The distance between the ring and the central hub 34 is defined such that the spokes 33 can be arranged in the receptacles 15 provided for this purpose on the lower part of component 1. The central hub 34 has a diameter substantially equal to the inside diameter of component 1, so as to be capable of passing through the central orifice 13 of component 1 and to make it possible to control radial displacement. The radial displacement of component 3 may take place either directly or by means of a control component 4, such as that shown in FIG. 1. The outer ring 32 of component 3 comprises segmental protuberances 31, six in the embodiment illustrated, which are intended for cooperating with the ramps 25 of component 2. The voids 35 provided in between the spokes 33 are designed for receiving the cleats 14 of component 1, while allowing free rotational movement of component 3 over a defined angle.

The device is used in the way described below. The device is placed in the circular orifice of the shell to be fastened. Component 1, comprising in its lower part component 3 and on its periphery component 2 bearing on the toothing of the shell, is fastened to the snowboard. In this way, the shell is held so as to be free or not in terms of rotation on the snowboard according to the position of the wheel 3. In fact, according to the angular position of the wheel 3, the protuberances 31 are in engagement with the ramps 25 and lay down component 2 toward the snowboard, at the same time gripping the shell and blocking it in terms of rotation by means of the toothing 21 which comes into engagement with the toothing of the shell, while, in another position of the wheel 3, the protuberances 31 free the ramps 25, thus making it possible to lift component 2, at the same time freeing the toothing 21 from the toothing of the shell and allowing a rotational movement of the latter. The angular movement of the wheel 3 will take. place by means of a lever 41 fastened to the cap 4.

The device will also comprise spring means, for example a helical spring arranged in the hub 34 of the wheel 3, holding the wheel 3 in the position in which the protuberances 31 are in engagement with the ramps 25, that is to say in the blocking position.

The fastening according to the invention may be produced from light metal, for example from aluminum alloy or from a synthetic material of suitable strength.

What is claimed is:

1. A device for fastening a shell intended for holding a boot on a snowboard, said shell having on its lower surface, a circular orifice for receiving said device for fastening the shell to the snowboard, characterized in that said device comprises a first component (1) fastened to the snowboard and having portions engaging portions of a second component (2) fixed in terms of rotation to said first component, at the same time leaving said second component free to move in the direction perpendicular to the snowboard over a defined distance, said second component having, on its lower surface, a toothing (21) corresponding to a toothing of said shell, said device also comprising a third component (3) arranged under said first component, and held fixedly thereby in the perpendicular direction, but able to rotate over a defined angle, said third component having, on its periphery, ramp-shaped segmental protuberances (31) in the direction perpendicular to the snowboard, said protuberances engaging corresponding ramps (25) on one side of said second component in such a way that a rotation of the third component (3) over a defined angle causes said second component to be moved downwardly against the shell, while at the same time holding said shell in a defined position relative to the snowboard.

2. The device as claimed in claim 1, characterized in that it comprises a fourth component (4) which is fastened to the third component (3) and is arranged above the first component (1) and which comprises means making it possible to move the third component in rotation.

* * * * *